US011319775B2

(12) United States Patent
Fuglestad

(10) Patent No.: US 11,319,775 B2
(45) Date of Patent: May 3, 2022

(54) DOWNHOLE TUBULAR SLEEVE VALVE AND USE OF SUCH A SLEEVE VALVE

(71) Applicant: T-Well AS, Stavanger (NO)

(72) Inventor: Kenneth Fuglestad, Bryne (NO)

(73) Assignee: T-WELL AS, Stavanger (NO)

( * ) Notice: Subject to any disclaimer, the term of this patent is extended or adjusted under 35 U.S.C. 154(b) by 0 days.

(21) Appl. No.: 17/268,299

(22) PCT Filed: Aug. 16, 2019

(86) PCT No.: PCT/NO2019/050166
§ 371 (c)(1),
(2) Date: Feb. 12, 2021

(87) PCT Pub. No.: WO2020/036494
PCT Pub. Date: Feb. 20, 2020

(65) Prior Publication Data

US 2021/0301623 A1 Sep. 30, 2021

(30) Foreign Application Priority Data

Aug. 16, 2018 (NO) ..... 20181085

(51) Int. Cl.
*E21B 34/10* (2006.01)
*E21B 34/14* (2006.01)

(52) U.S. Cl.
CPC ..... *E21B 34/10* (2013.01); *E21B 2200/06* (2020.05)

(58) Field of Classification Search
CPC ..... E21B 34/10; E21B 34/14; E21B 2200/06
See application file for complete search history.

(56) References Cited

U.S. PATENT DOCUMENTS 6,883,613 B2 * 4/2005 Bode ..... E21B 23/006 166/233
8,434,515 B2 * 5/2013 Nilssen ..... F16K 5/0464 137/625.47

(Continued)

FOREIGN PATENT DOCUMENTS

| | | |
|---|---|---|
| EP | 2 466 058 | 6/2012 |
| WO | 02/46575 | 6/2002 |
| WO | 2010/123588 | 10/2010 |

OTHER PUBLICATIONS

International Search Report dated Nov. 5, 2019 in corresponding International Application No. PCT/NO2019/050166.

(Continued)

*Primary Examiner* — Matthew R Buck
(74) *Attorney, Agent, or Firm* — Wenderoth, Lind & Ponack, L.L.P.

(57) ABSTRACT

A downhole tubular sleeve valve includes a rotary coaxial valve sleeve with a plurality of circumferentially spaced sleeve flow paths extending through the valve sleeve. The valve sleeve is located inside a housing. A plurality of circumferentially spaced outer bores extend through the housing and can be aligned with the plurality of sleeve flow paths. A protruding ring surround each of the circumferentially spaced outer bores inside the housing and form a protruding sealing surface conforming to a ported surface in the sleeve. A chamber exposed to the pressure outside the valve is formed between the housing and the sleeve, whereby a piston formed by the sleeve is exposed to the pressure outside the valve. A tension element biases a sealing surface on the sleeve towards each of the protruding ring surfaces.

13 Claims, 5 Drawing Sheets

(56) References Cited

U.S. PATENT DOCUMENTS

| | | | | |
|---|---|---|---|---|
| 9,080,421 | B2 * | 7/2015 | Holderman | E21B 43/12 |
| 9,322,244 | B2 * | 4/2016 | Hallundbæk | E21B 34/14 |
| 10,428,621 | B2 * | 10/2019 | Purkis | E21B 34/14 |
| 2003/0047702 | A1 * | 3/2003 | Gunnarsson | F16K 5/0478 251/297 |
| 2006/0284134 | A1 * | 12/2006 | Dwivedi | E21B 34/14 251/208 |
| 2011/0308622 | A1 | 12/2011 | Byberg et al. | |

OTHER PUBLICATIONS

Norwegian Search Report dated Feb. 7, 2019 in corresponding Norwegian Application No. 20181085.

* cited by examiner

DOWNHOLE TUBULAR SLEEVE VALVE AND USE OF SUCH A SLEEVE VALVE

FIELD OF THE INVENTION

The present invention relates to a rotary sleeve valve for use in controlling fluid flow between hydrocarbon reservoirs and oil or gas wells.

BACKGROUND TO THE INVENTION

Sleeve valves are typically used in hydrocarbon (oil or gas) wells to control the fluid flow from a hydrocarbon reservoir into the tubing being used for the extraction of the hydrocarbon from that reservoir. This is desirable because a hydrocarbon well typically intersects several producing zones in the reservoir, each of which may have a different flow performance or a different composition in terms of the proportions of e.g. oil, gas, and/or water that are present. In addition, it is likely that during the lifetime of a well, the various production zones will change in production character, for example, the flow may change from being predominantly oil-based, to being predominantly water- or gas-based. This change of fluid type, especially from oil to gas or water has a detrimental effect on the overall productivity of the well. Therefore, an operator of the well will generally wish to optimise the productivity of the well throughout its lifetime, by either closing or choking one or more of the various production zones in the wellbore.

Similarly, in the case of injection wells, sleeve valves may be used to control the rate of injection of fluids into the reservoir.

A typical valve used to control flow from or into a hydrocarbon reservoir comprises a coaxial inner sleeve and an outer tubular housing, each of which is provided with through-thickness ports that can be brought into or out of alignment with each other by sliding the inner sleeve relative to the housing in an axial direction. One disadvantage of these types of valves is that sliding the sleeve relative to the housing in an axial direction results in a change in internal volume of the valve. This may cause solids such as sand or scale to build up in the interior region of the valve, thus preventing smooth movement valve components relative to each other.

By contrast, rotary valves comprise a housing and a coaxial valve sleeve that may be rotated in the housing to bring their respective ports into or out of alignment. The interior volume of these valves does not change during use and so the problem of solids building up inside the valve during use is reduced.

Many valves rely on elastomeric gaskets to provide seals around the ports when the valve is in the closed position. However, such gaskets are easily damaged and it has been found that after these valves have been in the closed position for some time, it is often impossible to obtain sealing again when the valve is opened and then closed once more.

To avoid the problems that arise in connection with flexible gaskets, valves having metal-to-metal seals have been developed. However, such valves are typically complex in structure in order to provide the required sealing performance, and comprise many components that have to be engineered to a high level of precision.

WO201012358 discloses a fracture valve tool. The fracture valve tool includes a mandrel with a through passage. The mandrel has at least a first mandrel port extending from an exterior surface to an interior surface. A rotating sleeve with at least one sleeve port is rotatably positioned on the mandrel. The rotating sleeve rotates between a first position out of alignment with the at least one mandrel port and a second position where the at least one sleeve port is at least partially aligned with the mandrel port.

US2006284134 discloses variable radial flow rate control valve including a body forming a bore along the longitudinal axis thereof for transporting a fluid through the body. A fixed choke member is fixedly positioned about the bore. The fixed choke member form a fixed aperture. A rotational choke member is rotationally positioned about the bore. The rotational choke member forms a rotational aperture radially corresponding to the fixed aperture. A fluid passage is formed radially between the bore and the exterior of the body. The corresponding apertures overlap. The rotational choke member is rotatably, but not axially moveable in relation to the fixed choke member between variable radial flow rate positions.

It is desirable to provide a rotary sleeve valve for use in hydrocarbon wells that meets one or more of the following criteria:

i. it can withstand substantial differential pressure between the interior region of the valve and the region exterior to the valve, when the valve is in the closed position, without leakage occurring;
ii. it does not rely on the use of elastomeric gaskets to provide the intermittent sealing that is required to allow the valve to change between the open and closed positions;
iii. it provides reliable sealing in the closed position both when the pressure of the fluid outside the valve is greater than the pressure of the fluid inside the valve and when the pressure of the fluid inside the valve is greater than the pressure of the fluid outside the valve.

SUMMARY OF THE INVENTION

At its most general, the present invention may provide a sleeve valve that is configured such that the sealing performance of the valve in the closed position is assisted by the pressure of a fluid from the interior or exterior regions of the valve. This is achieved by providing a valve that is configured such that the interface at which the one or more ports of the inner and housings of the valve are configured to meet is oriented at 90° to 30° relative to the longitudinal axis of the valve. Fluid pressure is used to urge the valve sleeve against the housing at an interface, to provide a pressure seal when the valve is in a closed position.

Therefore, in a first aspect, the present invention provides a sleeve valve controlling fluid flow between a hydrocarbon reservoir and tubing in an oil and gas well in the hydrocarbon reservoir. The sleeve valve comprise a housing and a valve sleeve coaxially located inside the housing. The valve sleeve has a ported annular end portion defining a sleeve annular ported surface oriented at an angle of 90°-30° in relation to the longitudinal axis/the axial centre line of the sleeve valve. A plurality of circumferentially spaced sleeve flow paths extend between a plurality of valve sleeve outer ports in the sleeve annular ported surface and a plurality of valve sleeve inner ports in an axial bore of the valve sleeve. A plurality of circumferentially spaced outer bores extend between a plurality of housing inner ports in a housing inner ported surface and a plurality of housing outer ports in a housing outer surface. The plurality of valve sleeve outer ports can be aligned with the plurality of housing inner ports. A protruding ring surround each of the plurality of housing inner ports, form protruding ring surfaces conforming to the sleeve annular ported surface of the annular end portion of the valve sleeve in the housing. A sleeve first cylindrical portion and a first sealing radius $r_i$ and a sleeve step to a sleeve outer cylindrical portion and a second increased sealing radius $r_o$ on the valve sleeve forms a ring shaped piston. A housing inner cylindrical portion with the first radius and a housing annular step to a housing increased radius cylindrical portion in the housing forms a ring shaped inner wall. A chamber is confined by the sleeve outer cylindrical portion, the sleeve step, the sleeve first cylindrical portion, the housing inner cylindrical portion, the housing annular step and the housing increased diameter cylindrical portion. At least one aperture extend through the housing and into the chamber. A tension element biases the sleeve annular ported surface towards the protruding ring surfaces.

An annular area defined between the second increased sealing radius $r_o$ and the first sealing radius $r_i$ may be smaller than a total area $a_p \cdot n$ defined by an outer diameter of the protruding rings projected in a direction perpendicular to the longitudinal axis of the sleeve times the number n of protruding rings and greater than a total area $a_i \cdot n$ defined by an inner diameter of the protruding rings projected in a direction perpendicular to the longitudinal axis of the sleeve times the number n of protruding rings.

The housing annular ported surface may include one or more protruding portions each forming a contact surface configured to conform to the sleeve annular ported surface of the first annular portion. Each protruding portion may be provided by a protruding ring extending around the one or more outer ports.

The valve sleeve is rotatable relative to the housing to align the inner and outer ports and to provide fluid communication between the region outside the valve and the bore defined by the valve sleeve.

The sleeve valve includes one or more chambers located between the valve sleeve and the housing. Each of the one or more chambers is bound in the longitudinal direction of the valve by two walls that each extend outwardly from the longitudinal axis of the valve. The chamber or chambers also include an inner wall that is provided by the valve sleeve and an outer wall that is provided by the housing, the inner wall being disposed between the first annular portion and the outer wall, and the chamber being in fluid communication with the region outside the valve.

The valve may further include two seals or sealing rings to isolate the chamber or each chamber from the valve bore. The seals are located at opposite ends of the chamber in a longitudinal direction of the valve. Each seal is located between the inner and outer sleeves, and is provided by a ring surrounding the longitudinal axis of the valve. The area enclosed by the seal adjacent to the first annular portion is greater than the area enclosed by the seal distal from the first annular portion.

Each of the one or more contact surfaces has a respective outer perimeter and the sum of the areas contained within the respective outer perimeters, when projected onto a notional plane perpendicular to the longitudinal axis of the valve, is at least as great as the difference between the areas defined by the two sealing rings, when projected onto the notional plane.

The sum of the areas of the inner walls of the one or more chambers, when projected onto the notional plane, is at least as great as the sum of the areas of the internal openings of the one or more outer ports, when projected onto the notional plane.

The valve has a single floating component (that is, the valve sleeve). This simplifies construction and maintenance of the valve.

The valve is configured to allow the valve sleeve to be rotated relative to the housing between the following three positions:

a) one or more inner ports are in full alignment with one or more outer ports: this is the open configuration of the valve, which allows fluid to flow between the bore of the valve and the region exterior to the valve;
b) one or more inner ports are in partial alignment with one or more outer ports, to regulate the extent of flow through the valve;
c) the one or more inner ports are fully out of alignment with the one or more outer ports, such that there is no fluid communication between them. The one or more outer ports are sealed by the sleeve annular ported surface of the first annular portion.

The valve is configured to improve sealing when the one or more inner ports are fully out of alignment with the one or more outer ports.

In this case, two main scenarios typically occur:

i. the pressure of the hydrocarbon fluid outside the valve (that is, the pressure of the hydrocarbon reservoir) is greater than the fluid pressure in the bore of the valve; or ii. the pressure of the fluid in the bore of the valve is greater than pressure of the hydrocarbon fluid in the reservoir external to the valve: this typically occurs during the case of injection of fluids into the hydrocarbon reservoir.

In scenario (i), the pressure of the fluid in the chamber urges the inner and outer walls of the chamber apart, in an axial direction of the valve, thus urging the sleeve annular ported surface 18 of the first annular portion against the interior surface of the second annular portion. However, the one or more outer ports are also filled with hydrocarbon fluid having the same pressure as the fluid in the chamber (since both the chamber and the one or more outer ports are in fluid communication with the hydrocarbon reservoir). The pressure of the fluid in the one or more outer ports tends to urge the valve sleeve away from the outer ports, thus counteracting the action of the fluid in the chamber. This tends to undermine good sealing of the one or more outer ports.

In order to help ensure that the action of the fluid in the one or more outer ports does not overcome the action of the fluid in the chamber, the sum of the areas of the inner walls of the one or more chambers, when projected onto the notional plane, is at least as great as the sum of the areas of the internal openings of the one or more outer ports, when projected onto the notional plane. This helps to ensure that the forces acting on the valve sleeve due to the fluid in the chamber and the fluid in the one or more outer ports are at least in balance, and preferably favour a net force urging the valve sleeve against the one or more outer ports.

In scenario (ii), the force acting on the valve sleeve is primarily due to the pressure of the fluid in the bore of the valve. This fluid penetrates as far as the two seals that isolate the chamber from the bore of the valve. The pressure of the fluid that penetrates as far as the two seals acting on the area enclosed by the two seals urges the valve sleeve away from the one or more outer ports. The fluid pressure that penetrates as far as the outside of the protruding ring extending around the one or more outer ports tends to urge the valve sleeve towards the one or more outer ports. The sum of the areas of the outside of the protruding ring extending around the one or more outer ports, when projected onto a notional plane, is at least as great as the area between the two seals that isolate the chamber from the bore of the valve.

Typically, a tension element is provided in the chamber. The tension element is configured to urge the valve sleeve towards the second annular portion. This helps to ensure that when the valve is installed, the valve sleeve is in the required axial position relative to the housing, that is, the valve sleeve is in contact with the outer ports. Preferably, the force from the tension element should be relatively low, that is, sufficient to bring the valve sleeve into contact with the outer ports, but not so great that it inhibits rotation of the valve sleeve relative to the housing.

Preferably, the sleeve annular ported surface of the first annular portion and the surface of the one or more protruding rings surrounding the one or more ports in the housing each correspond to the surfaces of a truncated cone. These surfaces thus conform to each other. Typically, the cone has an internal angle α greater than 30° relative to the longitudinal axis of the valve. Typically, the cone has an internal angle of less than 60° relative to the longitudinal axis of the valve. The angle should not be so steep that it produces a wedging and sticking effect.

The present invention thus relate to a downhole tubular sleeve valve, with an inner central valve bore. The downhole tubular sleeve valve comprises a housing and a rotary coaxial valve sleeve located inside the housing. The valve sleeve has a ported annular end portion with an angle α between 90° and 30° to an axial centreline of the sleeve valve. The ported annular end portion defines a sleeve annular ported surface forming a flat ring portion when the angle α is 90° and a frustoconical portion when the angle α is 30°. A plurality of circumferentially spaced bores extend between a plurality of valve sleeve outer ports in the ported annular end portion, and a plurality of valve sleeve inner ports in an axial bore of the valve sleeve. A housing inner annular portion interior surface has a ring shape conforming to the valve sleeve annular ported surface of the annular end portion.

A plurality of circumferentially spaced bores extend between a plurality of housing inner ports in the housing annular inner surface, and a plurality of housing outer ports in an outer cylindrical surface of the housing. The plurality of valve sleeve outer ports can be aligned with the plurality of housing inner ports. A raised or protruding ring surround each of the plurality of housing inner ports, forms protruding ring surfaces. The valve sleeve furthermore includes a sleeve first cylindrical portion and a first sealing radius $r_i$ and a sleeve step to a sleeve outer cylindrical portion and a second increased sealing radius $r_o$ on the valve sleeve, whereby the step forms a ring shaped piston.

A housing reduced cylindrical portion has the first diameter and a housing annular step to a housing increased diameter cylindrical portion whereby the housing inner annular step forms a ring shaped inner wall. A chamber is confined by the sleeve outer cylindrical portion, the sleeve step, the sleeve first cylindrical portion, the housing inner cylindrical portion, the housing annular step and the housing increased diameter cylindrical portion. At least one pressure port or aperture extends through the housing and into the chamber. A tension element biases the sleeve annular ported surface towards the protruding ring surfaces.

An area defined by the sleeve step may be smaller than a total area $a_p \cdot n$ defined by an outer diameter of the protruding rings projected in a direction perpendicular to the longitudinal axis of the sleeve times the number n of protruding rings and greater than a total area $a_i \cdot n$ defined by an inner diameter of the protruding rings projected in a direction perpendicular to the longitudinal axis of the sleeve times the number n of protruding rings.

The sleeve annular ported surface and the protruding ring surfaces may be oriented at an angle α of between 30° and 60° relative to the longitudinal axis of the valve.

The sleeve annular ported surface and the protruding ring surfaces may be oriented at an angle α of 45° relative to the longitudinal axis of the valve.

The tension element may be selected from a group including of leaf springs, helical springs, disc springs, elastomeric material, and/or a combination thereof.

A number of circumferentially spaced bores in the valve sleeve may be is higher than the number of circumferentially spaced bores in the housing, and a diameter of a bore of the number of circumferentially spaced bores in the valve sleeve may be different from a diameter of an adjacent bore of the circumferentially spaced bores in the valve sleeve.

The sleeve valve may further include at least a first sealing ring inserted between the sleeve first cylindrical portion and the housing inner cylindrical portion and a second sealing ring may be inserted between the sleeve outer cylindrical portion and the housing increased diameter cylindrical portion.

The housing may include a threaded pin connection at a first end and a threaded box connection at a second end.

A central housing bore and an inner sleeve valve bore may have a uniform diameter. The housing may be assembled of a first coaxial housing portion and a second housing portion, and the housing inner annular step may be formed in the first coaxial housing portion and the housing annular portion inner surface may be formed in the second housing portion.

The protruding rings may be made as inserts inserted into the housing and, the inserts may be made of a material different from the material of the housing.

The sleeve valve may be used for controlling fluid flow between a hydrocarbon reservoir and tubing in an oil well in the hydrocarbon reservoir.

The downhole tubular sleeve valve defined above may be used for injecting fluids into a formation surrounding a well.

DETAILED DESCRIPTION

The invention will now be described by way of example with reference to the following FIGS. in which.

Figure 1:
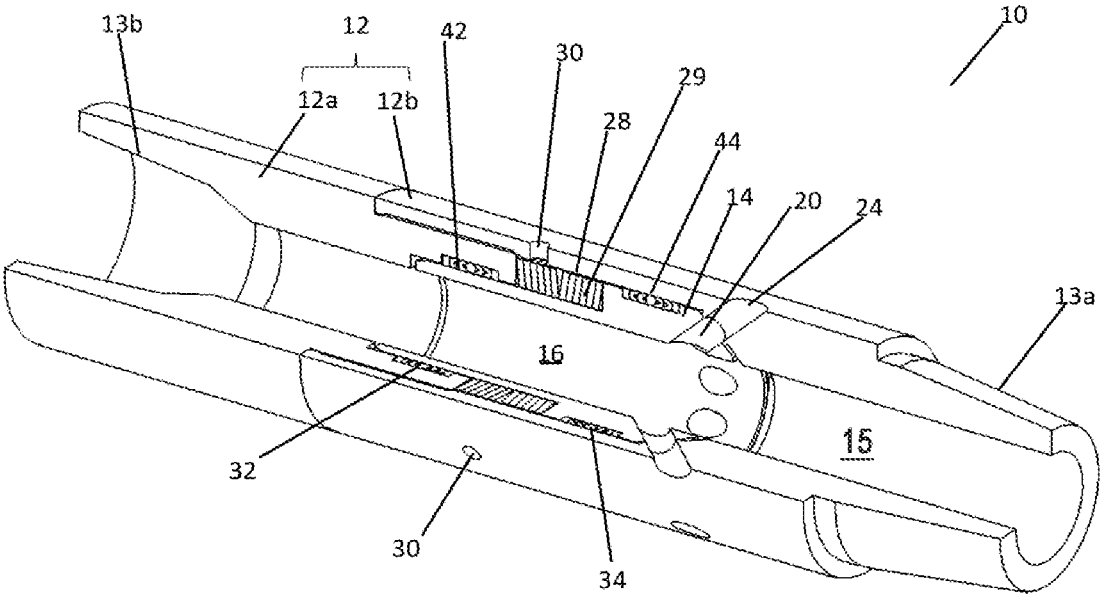
FIG. 1 is a perspective view of an embodiment of a sleeve valve according a first aspect of the invention, a longitudinal section of the valve being cut away to show through-thickness features of the valve.
Figure 2:
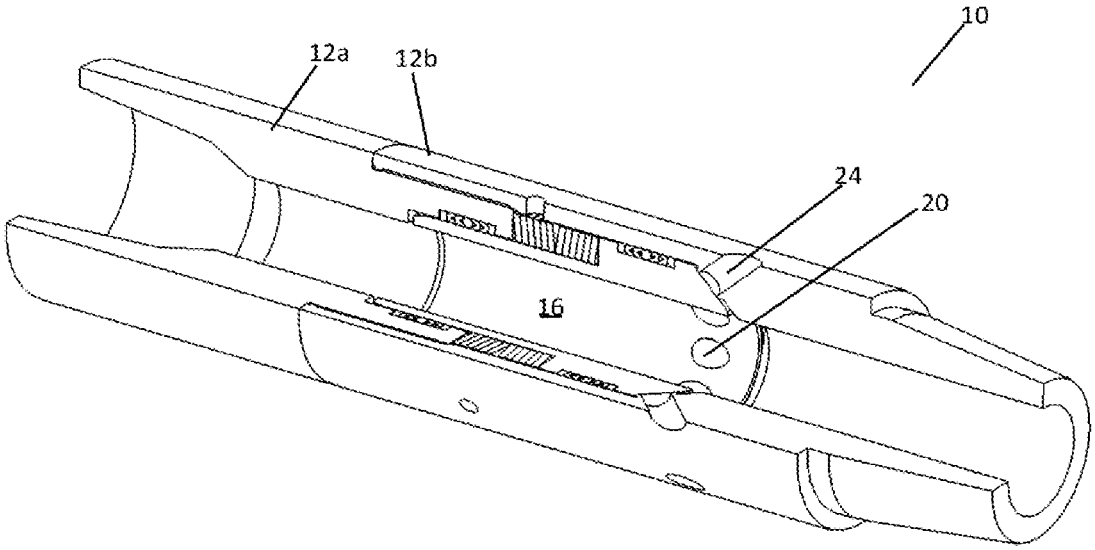
FIG. 2 shows the valve of FIG. 1 in an alternative configuration.
Figure 3:
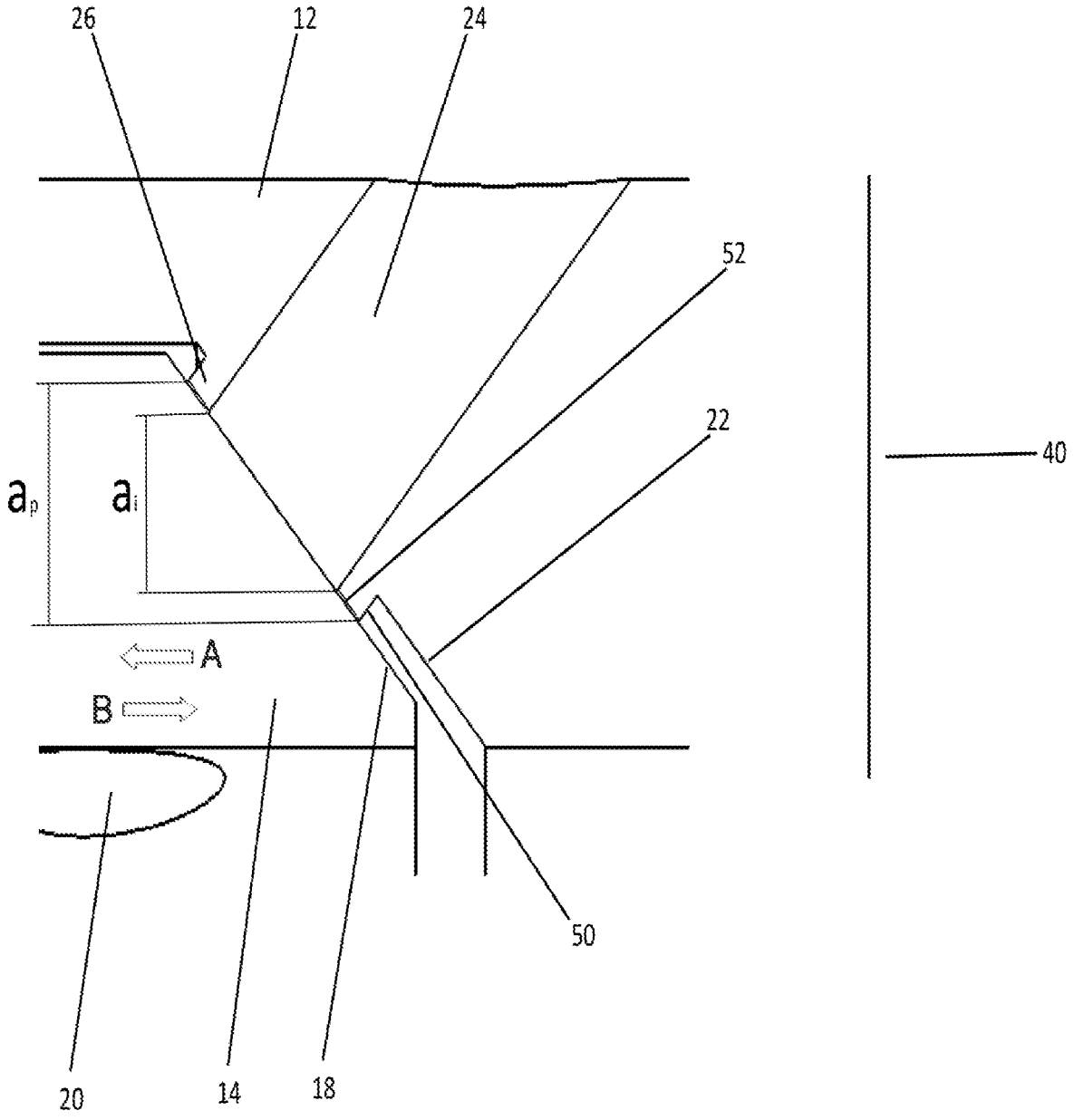
FIG. 3 is a cross-sectional view of a portion of the valve of FIG. 2.

Referring to FIGS. 1-3, a sleeve valve 10 comprises a housing 12 forming an outer sleeve, and a valve sleeve 14. The valve sleeve and housing are coaxial and the valve sleeve is located within the housing 12. The housing 12 is formed as two coaxial housing parts 12*a*, 12*b*. Housing part 12*a* is partly accommodated within housing part 12*b* and the two parts are bonded together at the region of overlap. The valve has a bore 16. A central housing bore and the valve sleeve axial bore 16 have a uniform diameter.

Sleeve valve 10 has a threaded pin connection 13*a* at one end and a threaded box connection 13*b* at the other end. The treaded pin connection and the threaded box connection are configured for connection to the remainder of the oil well production string.

Figure 4:
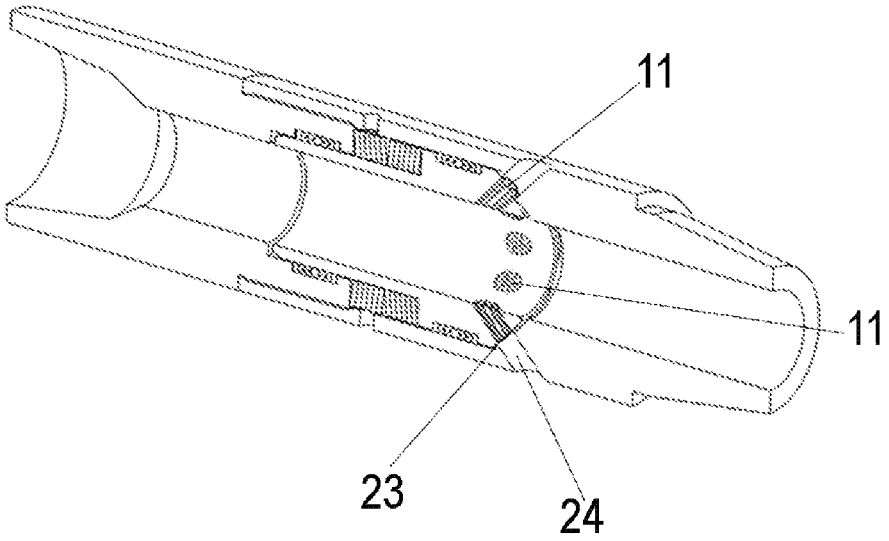
FIG. 4 shows the valve of FIG. 1 in an embodiment with variable flow area.

The valve sleeve 14 has a sleeve annular ported surface 18. The sleeve annular ported surface 18 may be considered as convex, conical, tapered or frustoconical as long as the sleeve annular ported surface 18 not is angled 90° in relation to a central axis through the downhole tubular sleeve valve. The sleeve annular ported surface 18 extends at an oblique angle α to the longitudinal axis of the valve and corresponds to the surface of a truncated cone. A plurality of circumferentially spaced sleeve flow paths 20 is provided in the convex sleeve annular ported surface 18, each of the circumferentially spaced sleeve flow paths 20 extend through the thickness of the valve sleeve 14, so as to provide fluid communication between the convex sleeve annular ported surface 18 and the valve sleeve axial bore 16. In the FIGS. 1, 2, 5 and 6 are the circumferentially spaced sleeve flow paths 20 inside shown as a single bore with a circular cross section and a bore diameter. In FIG. 4 are the circumferentially spaced sleeve flow paths 20 shown as multiple bores arranged within a circle with a diameter corresponding to the bore diameter.

The housing 12 has an interior surface forming the housing annular ported surface 22. The housing annular ported surface 22 may be considered as concave, conical, tapered or frustoconical as long as the sleeve annular ported surface 18 not is angled 90° in relation to a central axis through the downhole tubular sleeve valve. The interior surface may extend at an oblique angle to the longitudinal axis of the valve and corresponds to the surface of a truncated cone. This interior surface is configured to accommodate the convex sleeve annular ported surface 18 of the valve sleeve. A plurality of outer bores 24 are provided from the concave housing annular ported surface 22, each outer bore 24 extending through the housing 12 to provide fluid communication between the concave housing annular ported surface 22 and the region external to the valve.

Each outer bore 24 is provided with a protruding ring 26 with a concave surface 52 that is located on the housing annular ported surface 22 and extends around the perimeter of the outer bore 24. The concave surface 52 on the protruding ring 26 is forming a metal to metal seal against the convex sleeve annular ported surface 18.

An annular chamber 28 is provided between housing 12 and valve sleeve 14. The annular chamber is coaxial with the valve and is located between two gaskets formed as a first sealing ring 32 and a second sealing ring 34 respectively sealing against the first sealing surface 42 and the second sealing surface 44. That is, annular chamber 28 is bounded between the sealing surfaces 42 and 44.

A tension element 29 is positioned within annular chamber 28 and is coaxial with sleeve valve 10. The tension element 29 urges the convex sleeve annular ported surface 18 of valve sleeve 14 towards concave surface 52 on the protruding ring 26 bounding the outer bore 24.

Apertures 30 provide fluid communication between the annular chamber 28 and the region external to the valve.

Annular elastomeric gaskets or sealing rings 32, 34 are coaxial with the valve and the annular chamber 28, and are provided on opposite axial sides of annular chamber 28. Gasket/sealing ring 32 is located within an annular recess provided on the radially inwardly-facing surface of housing 12 sealing against the first sealing surface 42, while gasket 34 is located within an annular recess provided on the radially outwardly-facing surface of valve sleeve 14 sealing against sealing surface 44. The sealing surface 44 corresponds to the outer diameter of annular chamber 28, while the sealing surface 44 corresponds to the inner diameter of the chamber.

In use may valve sleeve 14 be rotated relative to housing 12 in order to bring the sleeve inner bores outer ports 21 and housing inner ports 23 into full alignment, thereby connecting sleeve bores/the circumferentially spaced sleeve flow paths 20 and housing bores/outer bores 24. This is the open configuration of the valve, shown in FIGS. 1 and 7, which allows fluid to flow from the region exterior to the valve (e.g. the hydrocarbon reservoir) into the bore of the valve, from which it may flow through further connected tubing in order to be extracted from the hydrocarbon well.

Alternatively, the circumferentially spaced sleeve flow paths/inner bores 20 and outer bores 24 may be only partially aligned to regulate the extent of flow through the valve.

In a further alternative, the circumferentially spaced sleeve flow paths or inner bores 20 and outer bores 24 and the respective ports may be brought fully out of alignment, such that there is no fluid communication between them. In this case, the valve is in its closed position, shown in FIGS. 2 and 3. The outer bores 24 are in contact with the convex annular ported surface 18 of the valve sleeve 14, through the contact between surface 52 on the protruding ring 26 and the convex annular ported surface 18 forming a metal to metal seal. Tension element 29 urges annular ported surface 18 against surface 52 on the protruding ring 26, thus providing an initial surface pressure and hence seal for the outer bores 24.

Additionally, fluid from the hydrocarbon reservoir is present within annular chamber 28 due to aperture 30, which provides fluid communication between the chamber and the region external to the valve. The pressure of the fluid (corresponding to the pressure within the hydrocarbon reservoir at the location of the valve) acts on the area enclosed by the two sealing rings 32 and 34 respectively sealing against sealing surfaces 42 and 44, thus urging the convex annular ported surface 18 of valve sleeve 14 towards surface 52 on the protruding ring 26 bounding the outer bores 24, so as to increase the effectiveness of the metal to metal sealing mechanism for the outer bores 24.

Gaskets/sealing rings 32, 34 respectively sealing against surfaces 42, 44 prevent leakage between the valve sleeve 14 and housing 12.

Referring to FIG. 3, fluid from the hydrocarbon reservoir is also present in outer bores 24, and presses against convex annular ported surface 18, thus urging valve sleeve 14 in direction A and tending to undermine good metal to metal sealing between the convex annular ported surface 18 and the concave surface 52. The surface area enclosed by the two sealing rings 32 and 34 sealing against sealing surfaces 42 and 44 respectively (FIG. 7), is greater than a perpendicularly projected total cross-sectional area of the internal openings of the protruding rings 26 surrounding each of the one or more outer ports. This perpendicularly projected total cross-sectional area is projected onto a notional plane 40 perpendicular to the longitudinal axis of sleeve valve 10. The surface area enclosed by the two sealing rings 32 and 34 (FIG. 7) sealing against sealing surfaces 42 and 44 forms a step 45 defining a ring shaped piston. This contributes to ensure that the force generated on the area enclosed by the two sealing rings 32 and 34 (FIG. 1) in direction B (that is, towards outer bores 24) is greater than the force generated in direction A (that is, away from outer ports) by the fluid present in outer bores 24.

In certain cases, typically in the case of injection of fluids into the oil well, the pressure inside the valve sleeve axial bore 16 is significantly greater than the pressure within the hydrocarbon reservoir. Referring to FIG. 3, internal fluid penetrates between convex annular ported surface 18 and concave housing annular ported surface 22, as far as gasket/sealing ring 34 and between valve sleeve 14 and the first housing part 12*a* of the housing where the internal fluid pressure generating force on the area enclosed by the two gaskets/sealing rings 32 and 34 respectively sealing against sealing surfaces 42 and 44. The internal fluid pressure tends to act to separate convex annular ported surface 18 from surface 52, thus urging the valve sleeve in direction A.

In order to prevent valve sleeve 14 to be urged in direction A, the following is necessary:

the area enclosed by the two sealing rings 32 and 34 respectively sealing against sealing surfaces 42 and 44 should be less than or equal to the total area covered by the outer diameter 50 of the protruding rings 26, when this is projected onto the notional plane 40 perpendicular to the longitudinal axis of sleeve valve 10.

FIG. 4 primarily corresponds to the 1, 2, 5 and 6 apart from showing an embodiment that can provide varying flow rate. The each of the circumferentially spaced bores is divided into set of multiple bores providing a variable flow area. The variable flow area is achieved by forming the each of the circumferentially spaced sleeve flow paths 20 on FIG. 1 as multiple bores 11 formed of a number of individual bores in a pattern allowing a variation of the number of bores that is covered by the housing inner ports 23, thus providing variable flow area upon rotation of the inner sleeve in relation to the housing. The housing is rotated in increments to ensure that each of the multiple bores 11 is either completely covered and thus not allow flow, or is completely open and thus allow flow. The Intermediate positions should be avoided to prevent erosion of the sealing surfaces. By forming each circumferentially spaced sleeve flow path as a pattern of as multiple bores 11 formed as a number of individual smaller bores inside a diameter of each circumferentially spaced sleeve flow path, can the all the individual small bores be covered by the housing inner ports 23.

Intermediate positions should also be avoided in the embodiments without ports/bores with multiple bores 11 of the same reason, and the increments in the rotation of the sleeve in these embodiments should thus be greater. The invention may thus include a mechanism that prevents location of the inner sleeve in intermediate positions.

Figure 5:
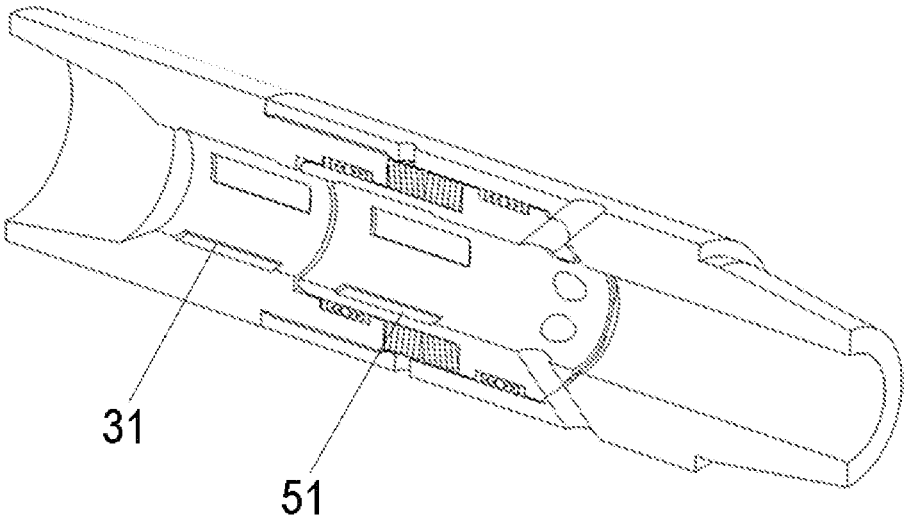
FIG. 5 shows the valve of FIG. 1 in an embodiment with recesses in the sleeve for actuation with a tool in the valve bore.

FIG. 5 primarily corresponds to the 1, 2, 4 and 6, apart from showing housing latch recesses 31 and sleeve latch recesses 51. An actuating tool may be inserted into the valve and latches on the tool may be moved into the latch recesses in the housing and in the sleeve. The sleeve latch recesses 51 provides a gripping surface for the tool. The latching between both the tool and the housing and the tool and the sleeve provides excellent control of the positioning of the sleeve in relation to the housing and thus the positioning of the ports in the sleeve and the ports in the housing. The tool gripping into the latch recesses may be a dedicated actuation tool with a fixed portion and a rotating portion and actuated latching members for selectively gripping or leasing the housing and the sleeve.

Figure 6:
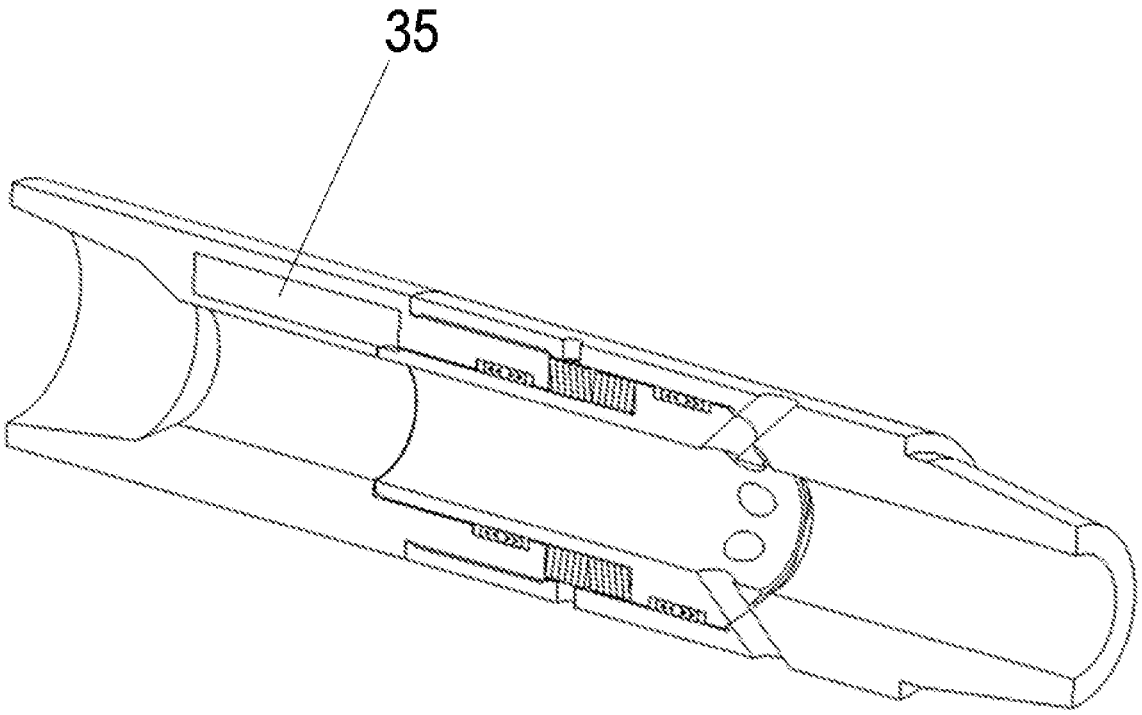
FIG. 6 shows the valve of FIG. 1 in an embodiment with an actuator in the housing for rotating the sleeve.

FIG. 6 primarily corresponds to the 1, 2, 4 and 5, apart from showing a rotation/valve actuator 35 for rotating the sleeve in increments in relation to the housing. The valve actuator 35 is typically an electric actuator. The valve actuator 35 may also be hydraulic.

The increments are typically sufficient to move the sleeve in a distance in a circumferential direction somewhat in excess of one diameter of a diameter of the outer ports of the sleeve.

The embodiments with both the multiple bores and the single bores may be actuated by an actuator or a tool.

Figure 7:
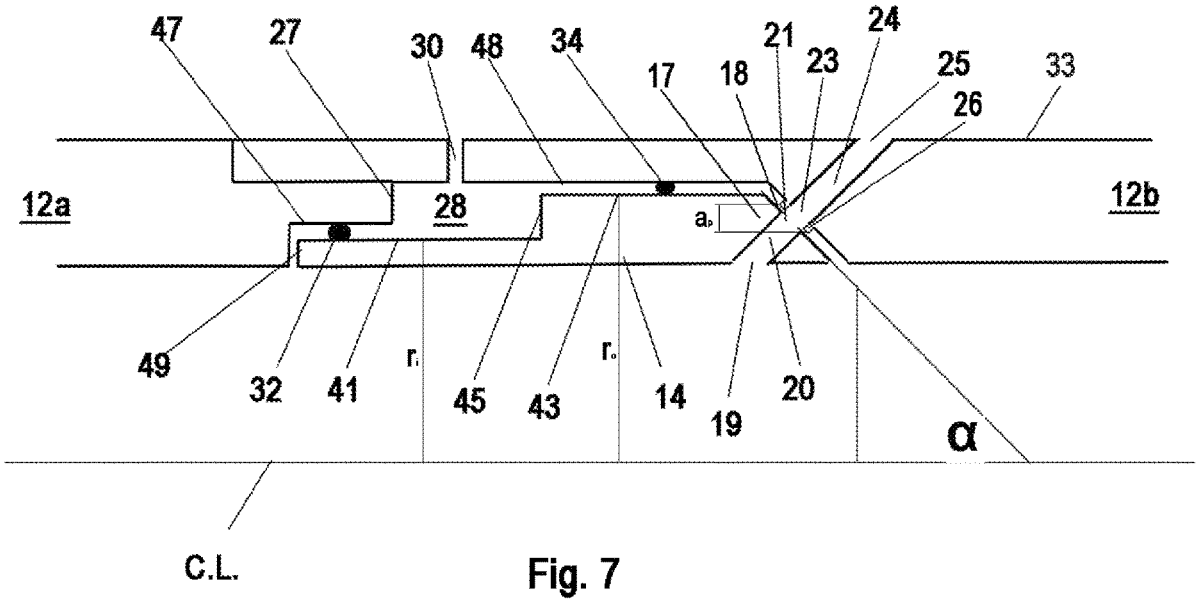
FIG. 7 is a schematic cross section to further highlight details of the invention.

FIG. 7 is a schematic cross section of a sleeve valve of the invention and as shown in FIGS. 1-3, enclosed to further highlight the invention. A first housing part 12*a* is secured to a second housing part 12*b* with a screw connection. The housing parts are tubular/cylindrical and have a cylindrical outer surface 33. The screw connection between the first and second housing part 12*a*, 12*b* allows the valve sleeve 14 to be installed before the housing 12 is assembled. The first housing part 12*a* also defines the housing annular step 27 and the housing inner cylindrical portion 47. The second housing part 12*b* defines a housing outer cylindrical portion 48, an aperture 30 allowing pressure into the annular chamber 28, and a sleeve annular ported surface 18 of a ported annular end portion 17. The housing annular ported surface (22 in FIG. 3) is shown with an inclination a of 45° to a centre line C.L.. This angle is of less importance as long as the surface of the protruding rings 26 seals against the valve sleeve 14.

The diameter of the housing inner cylindrical portion 47, corresponds to the diameter of the sleeve first cylindrical portion 41, and the diameter of the sleeve outer cylindrical portion 43, corresponds to diameter of the housing outer cylindrical portion 48. The sleeve first cylindrical portion 41 has a reduced diameter compared to the sleeve outer cylindrical portion 43. A height of the step 45 on the valve sleeve 14 and a height of the housing annular step 27 corresponds with the difference between the inner and outer portions. These diameters are more or less equal and have tolerances to allow the valve sleeve 14 to rotate and slide lengthwise somewhat in the housing 12, i.e. to prevent the valve sleeve 14 to be fixed to the housing 12.

The first and a second sealing ring 32 and 34 allow the valve sleeve 14 to rotate and shift slightly in the longitudinal direction in the housing 12 while keeping a fluid tight seal between the inner bore of the valve and the housing outer ports 25. A pressure outside the valve will enter the aperture 30 and act on the annular surface formed by step 45, and press the valve sleeve 14 to the right on the FIG. The sealing rings 32 and 34 define the area of step 45 when sealing rings are used. This area can be expressed as $\pi r_o^2 - \pi r_i^2$ where $r_o$ is the sealing radius of the sleeve outer cylindrical portion 43 and $r_i$ is the sealing radius of the sleeve first cylindrical portion 41. This assumes that the sealing rings 32 and 34 are located in recesses in the housing. If the sealing rings 32 and 34 are located in recesses in the sleeve as shown in FIG. 1, then the inner sealing radius $r_i$ and the outer sealing radius $r_o$ are the radiuses of the corresponding inner diameters of the housing, and the area of step 45 changes slightly. The pressure outside the valve will also act on an area corresponding to an area of each of the housing inner ports 23 times the number of ports in the housing 12 resulting in a force with a component in the opposite direction along the C.L when the valve is in a closed position. This area equals the area $n*a_i$ where n is the number of ports 23 and $a_i$ is the projected area of each port. This area should be less than the area of the step 45 (as defined by the sealing rings 32, 34) explained above. The area of the step 45 can be considered as the area the pressure in the annular chamber 28 between the first and second sealing ring 32 and 34, contacting the sealing surfaces 42, 44 shown on FIG. 1.

Each protruding ring 26 has an inner diameter defined by the housing inner ports 23 and a protruding ring outer diameter 50. The width of these raised or protruding rings 26 correspond to the difference between the above-mentioned diameters. The forces acting on the valve sleeve 14 to the right is distributed between the protruding rings 26, and must exceed the forces exerted by the external pressure projected in a direction parallel to the C.L. acting on the area of the housing inner ports 23 times the number of ports on the valve sleeve 14.

A circumferential distance between inner bores outer ports 21 must exceed a width of the protruding rings 26 outer diameters 50 to allow sufficient surface area on the annular ported surface 18 to produce a proper seal between the protruding rings 26 and the annular ported surface. The protruding rings 26 have a slightly curved front surface adapted to the curvature of the annular ported surface. In the event the angle a is 90°, then this surface is flat, and the above mentioned front surface is flat. The annular ported surface 18 is located on the ported annular end portion 17.

In other words, each of the one or more contact surfaces correlated with the one or more of the housing inner ports 23 has a respective outer perimeter/diameter 50 and the sum of the areas of the housing inner ports 23 contained within the respective outer perimeters, when projected onto a notional plane perpendicular to the C.L. is at least as great as the difference between the area of the step 45 enclosed by the first and second sealing rings 32, 34, when projected onto the notional plane. The sum of the areas of the inner walls of the one or more chambers, when projected onto the notional plane, is at least as great as the sum of the areas of the internal openings of the one or more outer ports, when projected onto the notional plane. "$a_i$" is shown on FIG. 3.

The protruding rings 26 may be integrated in the housing or may be inserted into the housing as protruding ring inserts. Protruding ring inserts may include non-metallic materials, ceramics, sintered materials, elastomeric materials, composite materials, metallic materials etc.

| | |
|---|---|
| 10 | Sleeve valve |
| 11 | multiple bores |
| 12 | Housing |
| 12a | First housing part |
| 12b | Second housing part |
| 13a | Pin connection |
| 13b | Threaded box connection |
| 14 | Valve sleeve |
| 15 | Housing bore |
| 16 | Valve sleeve axial bore |
| 17 | Ported annular end portion |
| 18 | Annular ported surface |
| 19 | Valve sleeve inner ports |
| 20 | Circumferentially spaced sleeve flow paths/inner bores |
| 21 | Inner bores outer ports |
| 22 | Housing annular ported surface |
| 23 | Housing inner ports |
| 24 | Outer bores |
| 25 | Housing outer ports |
| 26 | Protruding rings |
| 27 | Housing annular step |
| 28 | Annular chamber |
| 29 | Tension element |
| 30 | Aperture |
| 31 | Housing latch recess |
| 32 | First sealing ring |
| 33 | Cylindrical outer surface |
| 34 | Second sealing ring |
| 35 | Valve actuator |

-continued

| | |
|---|---|
| 40 | Notional plane |
| 41 | Sleeve first cylindrical portion |
| 42 | First sealing surface |
| 43 | Sleeve outer cylindrical portion |
| 44 | Second sealing surface |
| 45 | Step |
| 46 | Valve sleeve reduced diameter end face |
| 47 | Housing inner cylindrical surface |
| 48 | Housing outer cylindrical surface |
| 49 | Sleeve end step |
| 50 | Outer diameter of the protruding rings |
| 51 | Housing latch recess |
| 52 | Concave surface |

The invention claimed is:

1. A downhole tubular sleeve valve with an inner central valve bore comprising:

a housing and a rotary coaxial valve sleeve located inside the housing, wherein the valve sleeve has a ported annular end portion defining a sleeve annular ported surface with an angle α between 90° and 30° to a longitudinal axis of the sleeve valve;

a plurality of circumferentially spaced sleeve flow paths extending between a plurality of valve sleeve inner bores outer ports in the sleeve annular ported surface and a plurality of valve sleeve inner ports in an axial bore of the valve sleeve;

a plurality of circumferentially spaced outer bores extending between a plurality of housing inner ports in a housing annular ported surface and a plurality of housing outer ports in a housing outer surface, whereby the plurality of valve sleeve inner bores outer ports can be aligned with the plurality of housing inner ports;

a protruding ring surrounding each of the plurality of housing inner ports, forming protruding ring surfaces conforming to the sleeve annular ported surface of the ported annular end portion of the valve sleeve, in the housing;

a sleeve first cylindrical portion and a first sealing radius $r_i$ and a sleeve step to a sleeve outer cylindrical portion and a second increased sealing radius $r_o$ the valve sleeve, whereby the step forms a ring shaped piston;

a housing inner cylindrical portion with the first radius and a housing annular step to a housing increased radius cylindrical portion in the housing, whereby the housing annular step forms a ring shaped inner wall;

an annular chamber confined by the sleeve outer cylindrical portion, the sleeve step, the sleeve first cylindrical portion, the housing inner cylindrical portion, the housing annular step and the housing increased diameter cylindrical portion at least one aperture through the housing and into the annular chamber; and a tension element biasing the sleeve annular ported surface towards the protruding ring surfaces.

2. The sleeve valve according to claim 1, wherein an annular area defined between the second increased sealing radius $r_o$ and the first sealing radius $r_i$ is smaller than a total area $a_p$*n defined by an outer diameter of the protruding rings projected in a direction perpendicular to the longitudinal axis of the sleeve times the number n of protruding rings and greater than a total area $a_i$*n defined by an inner diameter of the protruding rings projected in a direction perpendicular to the longitudinal axis of the sleeve times the number n of protruding rings.

3. The sleeve valve according to claim 1, wherein the sleeve annular ported surface and the protruding ring surfaces are oriented at an angle α between 30° and 60° relative to the longitudinal axis of the valve.

4. The sleeve valve according to claim 1, wherein the sleeve annular ported surface and the protruding ring surfaces are oriented at an angle α of 45° relative to the longitudinal axis of the valve.

5. The sleeve valve according to claim 1, wherein the tension element is selected from a group including of leaf springs, helical springs, disc springs, elastomeric material, and/or a combination thereof.

6. The sleeve valve according to claim 1, wherein each circumferentially spaced sleeve flow paths in the valve sleeve is divided into a pattern of multiple bores.

7. The sleeve valve according to claim 1, further comprising at least a first sealing ring defining the first sealing radius $r_i$, inserted between the sleeve first cylindrical portion and the housing inner cylindrical portion and a second sealing ring defining the second increased sealing radius $r_0$, inserted between the sleeve outer cylindrical portion and the housing outer cylindrical portion.

8. The sleeve valve according to claim 1 wherein the housing includes a threaded pin connection at a first end and a threaded box connection at a second end.

9. The sleeve valve according to claim 1 wherein a central housing bore and a valve sleeve axial bore have a uniform diameter.

10. The sleeve valve according to claim 1 wherein the housing is assembled of a first coaxial housing part and a second housing part, and wherein the housing inner annular step is formed in the first coaxial housing part and the housing annular ported surface is formed in the second housing part.

11. The sleeve valve according to claim 1 wherein the protruding rings are made as inserts inserted into the housing and, wherein the inserts are made of a material different from a material of the housing.

12. Use of a sleeve valve according to claim 1 for controlling fluid flow between a hydrocarbon reservoir and tubing in an oil well in the hydrocarbon reservoir.

13. Use of a downhole tubular sleeve valve according to claim 1, for injecting fluids into a formation surrounding a well.

* * * * *